US005758834A

United States Patent [19]

Dragoo et al.

[11] Patent Number: 5,758,834

[45] Date of Patent: Jun. 2, 1998

[54] WELDING WIRE STORAGE AND SHIPPING CONTAINER

[75] Inventors: Robert K. Dragoo, St. Paris; Curtis C. Beckner, Covington, both of Ohio

[73] Assignee: Illinois Tool Works Inc., Chicago, Ill.

[21] Appl. No.: 699,969

[22] Filed: Aug. 20, 1996

[51] Int. Cl.[6] ..... B65H 49/00; B65H 18/28

[52] U.S. Cl. ..... 242/128; 242/171

[58] Field of Search ..... 242/128, 129, 242/157 R, 170, 171, 172; 206/389, 408, 409

[56] References Cited

U.S. PATENT DOCUMENTS

| | | | |
|---|---|---|---|
| Re. 28,917 | 7/1976 | Harris, Jr. | 72/183 |
| 2,752,108 | 6/1956 | Richardson | 242/128 |
| 3,863,861 | 2/1975 | Bellasio | 242/128 |
| 4,186,897 | 2/1980 | Brown | 242/128 X |
| 4,602,753 | 7/1986 | Kosch | 242/156.2 |
| 4,754,937 | 7/1988 | Hoddinott et al. | 242/128 |
| 4,869,367 | 9/1989 | Kawasaki et al. | 242/171 X |
| 5,277,314 | 1/1994 | Cooper et al. | 242/128 X |

FOREIGN PATENT DOCUMENTS

| | | | |
|---|---|---|---|
| 23552 | 2/1982 | Japan | 242/128 |
| 51655 | 3/1982 | Japan | 242/128 |
| 2203761 | 10/1988 | United Kingdom | 242/128 |

*Primary Examiner*—Michael Mansen

*Attorney, Agent, or Firm*—Mark W. Croll; E. Paul Forgrave

[57] ABSTRACT

A wire container 10 includes wire control apparatus 100 mounted at the upper part of an inner core 25 and provided with a plurality of fingers 140 mounted on a ring 110 and diverter apparatus in the form of tie-down wires 120 for preventing the wire from entering into the space between the ring 110 and the core 25. The fingers 140 subtend an arc of slightly greater than 30° and extend into contact with the outer drum member 20 to insure that the wire 35 is forced against the inner surface of the drum as the wire is removed. The stiffness of the fingers 140 is such that the wire cannot by itself uncoil and exit the drum, but it not so stiff that the resistance to wire movement from the drum adversely affects the wire feeding process.

11 Claims, 3 Drawing Sheets

WELDING WIRE STORAGE AND SHIPPING CONTAINER

BACKGROUND OF THE INVENTION

This invention relates to an improved container for wire, particularly welding wire.

Welding wire is often shipped in a cylindrical drum which includes an inner cylindrical inner core. The wire is placed between these two members and is held in place during shipment by two foam blocks diametrically through the inner core across the top of the wire coil. When it is desired to use the wire, the foam blocks are removed and a cone assembly is mounted at the top of the container. The cone assembly includes a rotating payoff arm that is provided with an eyelet at its end and a central conduit for guiding the wire to a wire feeder mechanism.

In the prior art container, a suspended float ring assembly is placed on top of the wire in the container to assist in keeping the wire from becoming tangled as it is fed out of the container. The suspended float ring assembly includes an annular metal ring that surrounds the inner core and a plurality of flexible fingers (twelve, in one device) or feathers that extend radially outwardly and slightly upwardly of the ring and into contact with the inner surface of the drum. These fingers, constructed of plastic, are approximately ⅝ inch wide and 9 inches long. The float ring is suspended, that is, it rests freely at the top of the coil of wire in the container.

In some prior art containers, several problems would be encountered. For example, as the wire was removed from the container, a part of the wire coil would spring upwardly and become caught between the float ring and the inner core, causing a tangle. Also, the wire above the float ring would sometimes wrap around the inner core, particularly as the float ring assembly descended downwardly as the container emptied. Further, surface contaminants on the wire might not all be removed as the wire is pulled from the drum. What is needed is an improved container that is not subject to wire tangling as the wire is removed therefrom and which provides improved cleaning of the wire during removal.

SUMMARY OF THE INVENTION

In the present invention, the suspended float ring of the prior art container is replaced with an improved wire control ring mounted at the upper part of the inner core and provided with improved fingers and means for preventing the wire from entering into the space between the ring and the core.

The improved wire control ring of the present invention includes an annular metal ring having an inner diameter which is slightly greater than the outer diameter of the drum's inner core, and an outer diameter which permits the unobstructed removal of wire from the drum. A set of three or four fingers or feathers attached to the ring extend outwardly and slightly upwardly into contact with the inner surface of the drum. The width of these fingers is significantly greater than the width of the prior art feathers and insure that the wire is forced against the inner surface of the drum as it is pulled from the drum and removed. The stiffness of the feathers is such that the wire cannot by itself uncoil and exit the drum, but it not so stiff that the resistance to wire movement from the drum adversely affects the wire feeding process. A diverter member prevents wire from inadvertently entering the space between the ring and the drum's inner core.

It is therefore an object of this invention to provide an improved wire control device for controlling the dispensing of wire from wire storage drums.

It is a further object of this invention to provide an improved wire control apparatus which prevents wire from uncoiling from a storage drum while at the same time cleaning the wire as it is pulled from the drum.

It is a still further object of this invention to provide, in a container for wire comprising a cylindrical outer member normally positioned with its central axis vertical, a cylindrical inner member placed coaxial of the outer member and having a length substantially equal to the length of the outer member, and a ring member surrounding and attached to the inner member near the upper end thereof, and a plurality of fingers extending radially outwardly of the ring member into engagement with the inside surface of the outer member, the improvement comprising each of the fingers subtending an arc sufficient to cause a wire extending upwardly past the ring member to engage both the inner surface of the outer member and the finger to form a wiping contact therebetween.

It is another object of this invention to provide a wire control apparatus for use in a container for wire which comprises a cylindrical outer member normally positioned with its central axis vertical, a cylindrical inner member coaxially positioned with respect to the outer member and having a length substantially equal to the length of the outer member, the wire control assembly including a flat ring member attached to the inner member near the upper end thereof and extending radially outwardly from the inner member into close proximity to the outer member, a plurality of tie-down members extending upwardly from the inner cylindrical member to the ring member to hold the ring member in place, and a plurality of fingers extending radially outwardly and upwardly of the ring member and into engagement with the inside surface of the outer member, each of the fingers subtending an arc sufficient to cause a wire extending upwardly past the ring member to engage both the inner surface of the outer member and the finger to form a wiping contact therebetween.

It is another object of this invention to provide a method of controlling the dispensing of wire from a container formed by a pair of normally vertical, coaxial cylindrical members, the method including the steps of placing a flat, annular ring in the container near the top thereof, the ring having an inside diameter slightly larger than the innermost cylindrical member and an outside diameter spaced from the outermost cylindrical member, placing a plurality of finger members on the ring member to extend radially outwardly and upwardly from the ring member and into engagement with the inside surface of the outermost member, each finger member being tapered in the direction of wire movement from the ring member outwardly and subtending an arc of approximately 30°, and passing the wire upwardly past each finger member whereby the wire engages both the inner surface of the outermost member and the finger members to form a wiping contact therebetween.

Other objects and advantages of the invention will be apparent from the following description, the accompanying drawings and the appended claims.

DESCRIPTION OF THE PREFERRED EMBODIMENT

Figure 1:
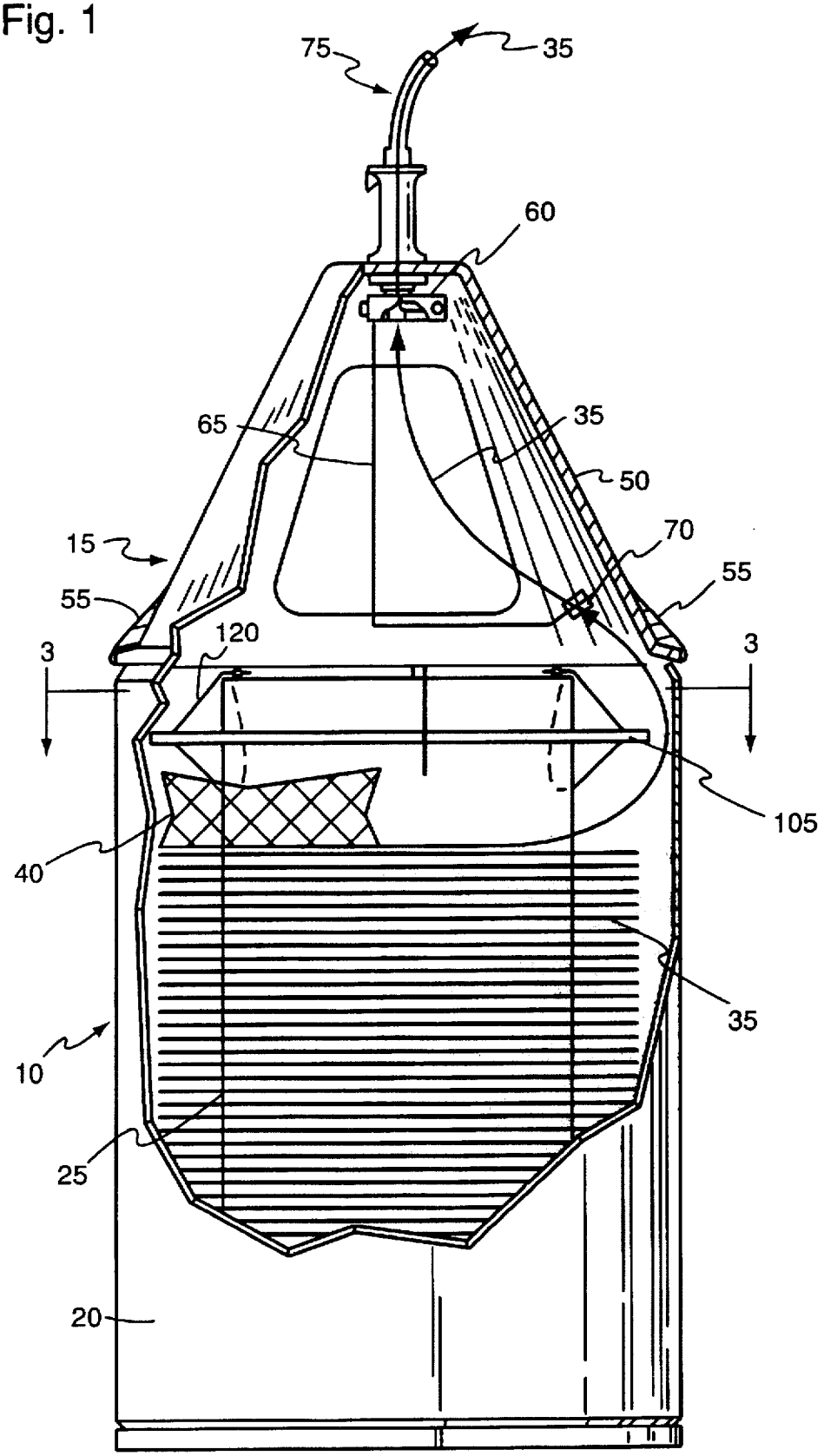
FIG. 1 is a side elevational view of a wire container or drum of the present invention with a payout mechanism attached to the top thereof.

Referring now to the drawings which illustrate a preferred embodiment of this invention, a wire container or drum 10 is shown with a payout mechanism 15 attached at the top thereof.

Figure 2:
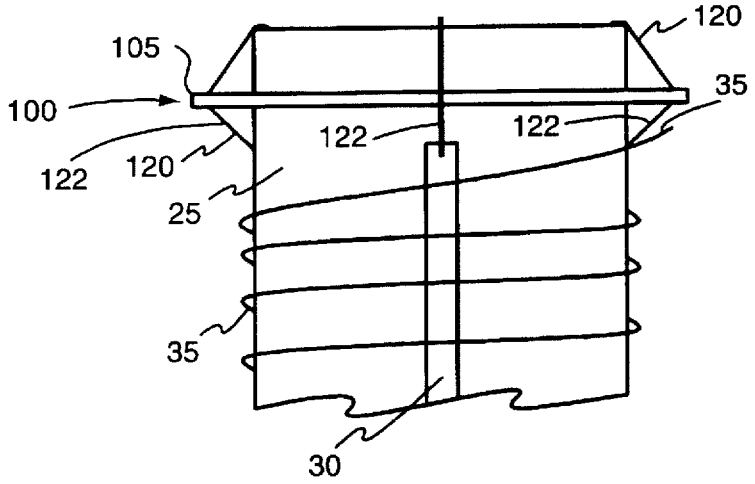
FIG. 2 is a side elevational view of the inner core showing one of the two longitudinal slots through which foam shipping blocks may be placed and through which one of the tie-down wires extends to hold the wire control ring in position near the top of the inner core.

The container 10 is of conventional design and includes an outer cylindrical member 20 and a coaxial inner cylindrical member 25. A pair of half-inch wide slots 30 (FIG. 2) are formed on opposite sides of the inner member 25. These slots start approximately three inches from the top of the inner member and extend downwardly approximately 11 inches. Wire 35, typically welding wire, is placed into the container in the space between the inner and outer members. A lid, not shown, is placed at the top of the container during shipment, or when the wire is being stored. The lid is removed and the payout mechanism 15 installed in its place when the wire is to be used.

During shipment and storage, foam blocks 40 are placed through the slots 30 to keep a downward force on the wire to hold the wire down in the container and to prevent it from unwinding. The blocks 40 are removed prior to the payout mechanism 15 being attached.

The payout mechanism 15 is also of conventional design and includes a conical shaped housing 50 shown with a portion of its outer surface broken away to reveal the components contained inside. The bottom of the mechanism is the same size as the lid and fits on the top of the container. It is held in place at the top of the container by clips 55. A bearing assembly 60 at the top of the housing 50 carries an arm 65 which extends downwardly from the bearing to the top of the container where it then extends radially to a position approximately directly above the innermost member 25. The wire 35 extends through a eyelet 70 at the end of the arm 65, then continues upwardly through the bearing assembly 60 and through a conduit 75 to the work.

A wire control assembly 100 is attached to the top of the inner member 25. One component of the wire control assembly is a horizontally mounted annular metal ring member 105, which has an inner diameter A to surround closely the inner member 25 and an outer diameter B which is within approximately one-half inch of the inside of the outermost cylindrical member 20. In a typical container, the inside diameter of the outer member 20 is approximately 20 inches; however because the container typically is made of cardboard, this dimension may vary around the inner circumference of the container.

In the preferred embodiment of the invention, the ring 105 is stamped from a 0.030 inch thick sheet of galvanized steel. The ring 105 is secured near the top to the inner member 25 by means of four tie-down wires 120 spaced at approximately 90° intervals, two of which extend from the top of slots 30, through the ring 105, over the top of the inner member 25 and back to the slot. The other two wires extend through holes formed in the wall of the inner member. In addition to securing the ring in place, the lower potion 122 of the tie-down wires serve as upwardly sloping diverter members; they perform the additional function of preventing a loop of the wire 35 from entering into the space 125 between the ring 105 and the inner member 25.

Figure 3:
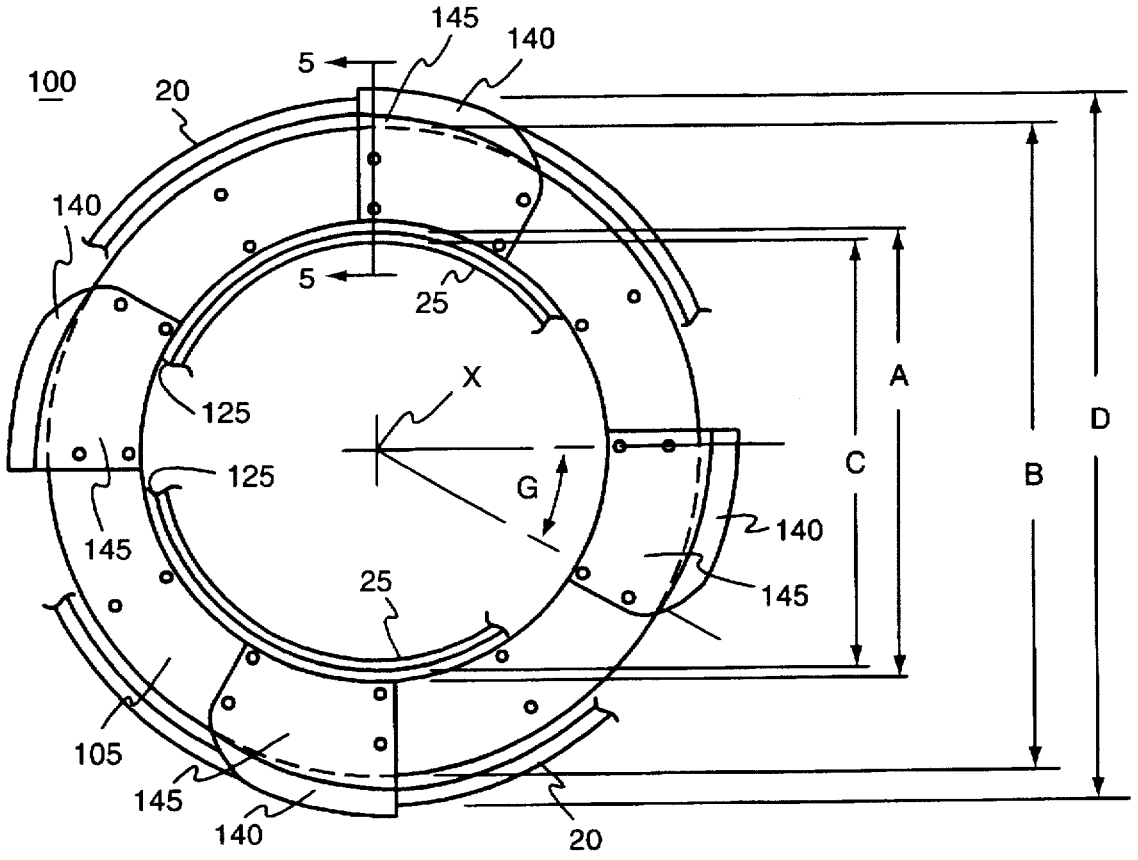
FIG. 3 is a plan view of the wire control ring with outwardly extending fingers attached and with a portion of the inner and outer cores shown to show the relationship among these components.

The ring 105 is annular, having an inside diameter A of 13¼ inches and an outside diameter B of 19 inches. As shown in FIG. 3, the inner member has a nominal diameter of C of 13 inches and the outer member has a nominal inside diameter D of 20 inches. Lips 130 and 135 are formed on the inner and outer edges, respectively, of the ring to provide stiffness. Typically, each lip is 7/32 inch in height.

Figure 4:
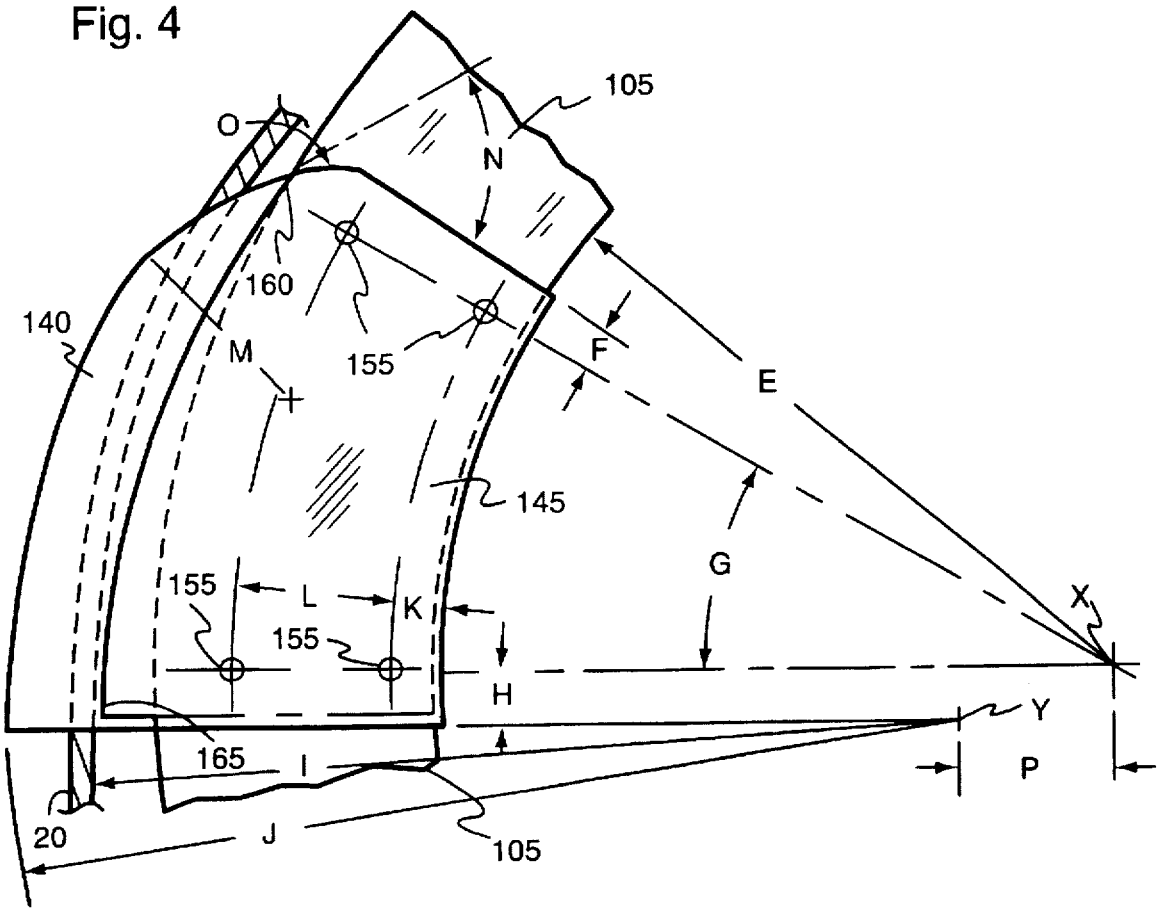
FIG. 4 is a plan view of one of the fingers and back plate.
Figure 5:
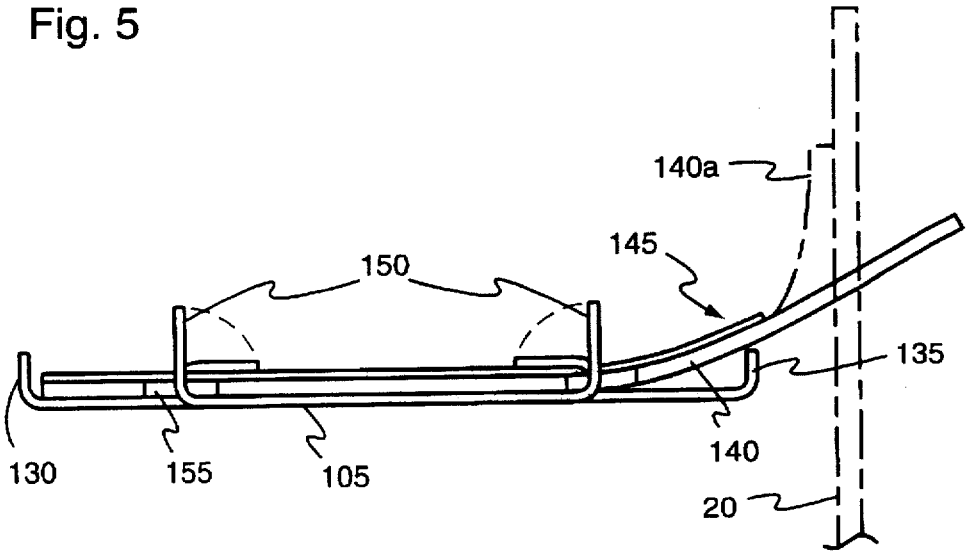
FIG. 5 is a cross sectional view taken along line 5—5 of FIG. 3 showing the attachment of a finger and back plate to the wire control ring.

The wire control assembly 100 is provided with a plurality of fingers 140 that extend outwardly from the ring 105, as shown in FIGS. 3–5. In the preferred embodiment, four fingers are used, each subtending an angle slightly greater than 30° from the center X of the ring. The fingers are preferably flat, die cut pads of fabric-backed vinyl approximately 1/16 inch thick. The fingers are cut in the shape shown in FIG. 4 and have the following dimensions:

E=6 11/16 inch radius
F=½ inch
G=30°
H=½ inch
I=8½ inch
J=9⅜ inch
K=½ inch
L=1 9/16 inch
M=2 inch radius
N=58°
O=1 in. radius
P=1½ inches A set of back plates 145 are also part of the wire control assembly 100. Each back plate 145 is preferably made of a relatively stiff but bendable material, such as chip board approximately 0.030 inch thick. It is cut as shown in FIGS. 3–5 and extends over the lip 135 to stiffen the vinyl finger 140. The fingers 140 and the back plates 145 are attached to the ring 105 by bend-over tabs 150 (FIG. 5) which are cut into the ring at 30° increments and which extend through holes 155 formed in both the fingers 140 and the back plates 145. The center of curvature Y for the back plate can be seen to be displaced from the center of curvature X of the ring downwardly and to the right (as seen in FIG. 4) by the distances H and P, respectively.

As shown in FIG. 5, the lip 135 forces each finger 140 and back plate 145 to extend upwardly as it extends outwardly from the ring 105. The wire 35 rotates counterclockwise, as viewed in FIGS. 3 and 4, as it exits the container. Accordingly, the outside edge of each back plate 145 is tapered and increases in radius from its right edge 160, which is the same radius as the ring 105, to its left edge 165, which extends outwardly approximately one-half inch from the ring 105 and is thus touching or almost touching the inner surface of the outer member 20. As shown by the dashed lines in FIG. 5, the finger 140 and back plate 145 will bend upwardly in contact with the member 20. This will cause the wire to pass between the finger 140 and the outer member 20, thus aiding in the cleaning of the wire as it exits the container.

In summary, the present invention replaces the suspended float ring of the prior art container. An improved wire control apparatus is mounted at the upper part of the inner core which includes a plurality of wide fingers and diverter means for preventing the wire from entering into the space between the ring and the core. Specifically, the improved wire control apparatus of the present invention includes a metal ring 104 having an inner diameter A which is slightly greater than the outer diameter of the drum's inner core member 25, and an outer diameter B which permits the unobstructed removal of wire 35 from the drum. Fingers 140 extend outwardly and slightly upwardly into contact with the inner surface of the drum. The width of these fingers is significantly greater than the width of the prior art feathers to insure that the wire is forced against the inner surface of the drum as the wire is removed. The stiffness of the fingers 140 is such that the wire cannot by itself uncoil and exit the drum, but it not so stiff that the resistance to wire movement from the drum adversely affects the wire feeding process. A back plate 145 may be provided to increase the stiffness of the fingers. Tie-down wires 120, in addition to holding the ring in place at the top of the innermost member 25, also function as a wire diverter mechanism.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. In a container for wire comprising a cylindrical outer member normally positioned with its central axis vertical, a cylindrical inner member placed coaxial of said outer member and having a length substantially equal to the length of said outer member, and a ring member surrounding and attached to said inner member near the upper end thereof, and a plurality of fingers extending radially outwardly of said ring member into engagement with the inside surface of the outer member, wherein each of said fingers subtending an arc sufficient to cause a wire extending upwardly past said ring member to engage both said inner surface of said outer member and said finger to form a wiping contact therebetween.

2. A container for wire comprising a cylindrical outer member normally positioned with its central axis vertical, a cylindrical inner member placed coaxial of said outer member and having a length substantially equal to the length of said outer member, and a ring member surrounding the inner member means for attaching said ring member near said upper end of said inner member, a plurality of fingers extending radially outwardly and upwardly of said ring member into engagement with said inside surface of said outer member, each of said fingers subtending an arc sufficient to cause a wire extending upwardly past said ring member to engage both said inner surface of said outer member and said finger to form a wiping contact therebetween.

3. A container for wire comprising a cylindrical outer member normally positioned with its central axis vertical, a cylindrical inner member placed coaxial of the outer member and having a length substantially equal to the length of said outer member, and a ring member surrounding said inner member means for attaching said ring member near the upper end of said inner member, a plurality of fingers extending radially outwardly and upwardly of said ring member into engagement with said inside surface of said outer member, each of said fingers subtending an arc sufficient to cause a wire extending upwardly past said ring member to engage both said inner surface of said outer member and said finger to form a wiping contact therebetween.

4. The apparatus of claim 3 wherein said ring member is attached to said upper end of said inner member by tie-down wires.

5. The apparatus of claim 4 wherein said tie-down wires form an upwardly sloping diverter to prevent the wire from extending between said ring member and the cylindrical inner member.

6. A wire control apparatus for use in a container for wire which comprises a cylindrical outer member normally positioned with its central axis vertical, a cylindrical inner member coaxially positioned with respect to the outer member and having a length substantially equal to the length of said outer member, said wire control apparatus including a flat ring member attached to the inner member near the upper end thereof and extending radially outwardly from said inner member into close proximity to the outer member, a plurality of tie-down members extending upwardly from the inner cylindrical member to said ring member to hold said ring member in place, and a plurality of fingers extending radially outwardly and upwardly of said ring member and into engagement with said inside surface of said outer member, each of said fingers subtending an arc sufficient to cause a wire extending upwardly past said ring member to engage both said inner surface of said outer member and said finger to form a wiping contact therebetween.

7. The wire control apparatus of claim 6 wherein said finger 5 are made of vinyl.

8. The wire control apparatus of claim 6 wherein said plurality of fingers includes four fingers separated at 90° intervals, and where each of said fingers extends for an arc of approximately 30°.

9. A wire control apparatus for use in a container for wire which comprises a cylindrical outer member normally positioned with its central axis vertical, a cylindrical inner member coaxially positioned with respect to the outer member and having a length substantially equal to the length of said outer member, said wire control assembly including a flat ring member attached to the inner member near the upper end thereof and extending radially outwardly from said inner member into close proximity to the outer member, a plurality of tie-down members extending upwardly from the inner cylindrical member to said ring member to hold said ring member in place, and a plurality of fingers extending radially outwardly and upwardly of said ring member and into engagement with said inside surface of said outer member, each of said fingers subtending an arc sufficient to cause a wire extending upwardly past said ring member to engage both said inner surface of said outer member and said finger to form a wiping contact therebetween, and a flexible back plate placed over said fingers, said back plate being tapered in the direction of wire movement as the wire is removed from the container from the ring to close proximity to the inner surface of the outer member.

10. A method of controlling the dispensing of wire from a container formed by a pair of normally vertical, coaxial cylindrical members, the method including the steps of placing a flat, annular ring in the container near the top thereof, the ring having an inside diameter slightly larger than the innermost cylindrical member and an outside diameter spaced from the outermost cylindrical member, placing a plurality of finger members on the ring member to extend radially outwardly and upwardly from the ring member and into engagement with the inside surface of the outermost member, each finger member being tapered in the direction of wire movement from the ring member outwardly and subtending an arc of approximately 30°, and passing the wire upwardly past each finger member whereby the wire engages both the inner surface of the outermost member and the finger members to form a wiping contact therebetween.

11. The method of claim 10 further comprising the step of placing a plurality of upwardly sloping diverter members below the ring to prevent wire from the container from entering the space between the annular ring and the innermost member.

* * * * *